United States Patent [19]

Kandatsu

[11] 4,278,958

[45] Jul. 14, 1981

[54] ELECTROMAGNETICALLY OPERATED MULTI-POLE CIRCUIT BREAKER

[75] Inventor: Kiyoshi Kandatsu, Kawasaki, Japan

[73] Assignee: Fuji Electric Co., Ltd., Kawasaki, Japan

[21] Appl. No.: 54,744

[22] Filed: Jul. 5, 1979

[30] Foreign Application Priority Data

Jul. 5, 1978 [JP] Japan ..... 53/81599

[51] Int. Cl.[3] ..... H01H 75/00; H01H 77/00; H01H 83/00

[52] U.S. Cl. ..... 335/16; 335/10

[58] Field of Search ..... 335/16, 8, 9, 10

[56] References Cited

U.S. PATENT DOCUMENTS

| | | | |
|---|---|---|---|
| 3,500,266 | 3/1970 | Torre | 335/16 |
| 4,144,513 | 3/1979 | Shaffer et al. | 335/16 |
| 4,146,855 | 3/1979 | Schultz et al. | 335/16 |

*Primary Examiner*—Harold Broome

*Attorney, Agent, or Firm*—Sughrue, Rothwell, Mion, Zinn and Macpeak

[57] ABSTRACT

A circuit breaker having stationary contactors provided for all of the poles thereof. Movable contactors are provided for all of the poles in correspondence to the stationary contactors. Stationary contacts are provided on the end portions of stationary contactors and movable contacts are disposed on the end portions of the movable contactors. The movable contactors are movable from the stationary contactors by electromagnetic force to open respective circuits before the circuit breaker is opened by an overcurrent tripping device when large current such as short-circuit current flows. Holders adapted to hold the movable contactors of all of the poles are mounted on a common rotatable insulating rod, one of the holders being provided with a latch which is turnable around a rod provided on the holder. A slot is normally engaged with the latch, and when disengaged from the latch, a rod can be turned by the holder. A spring operates to engage the latch with the rod until an electromagnetic moment acting on the latch generated in any of the poles or the sum of electromagnetic forces generated in all of the poles reaches a predetermined value. When a predetermined value is exceeded, the movable contactors of all of the poles are simultaneously moved from the stationary contactors to open the respective circuits with the aid of the insulating rod and the holders.

6 Claims, 7 Drawing Figures

ELECTROMAGNETICALLY OPERATED MULTI-POLE CIRCUIT BREAKER

BACKGROUND OF THE INVENTION

This invention relates to a multi-pole circuit breaker comprising current limiting devices in which, when a large current such as short-circuit current flows, the contactors are operated to open the circuits to increase the arc voltages before the ordinary switching mechanism is operated. The current limiting interruption is carried out with the subsequent circuit opening operation of the switching mechanism.

A current limiting device employing electromagnetic repulsion force utilizes an electromagnetic force generated by currents flowing in two parallel conductors in opposite directions. An ordinary arrangement of the current limiting device is as described below. The movable contactor and the stationary contactor are arranged in parallel with each other so that current flows in the contactors in the opposite directions. As soon as a large current flows, one or both of the movable contactor and the stationary contactor are separated from each other against the elastic force of a spring providing a contact pressure by utilizing an electromagnetic force generated between the contactor, before this prior art circuit opening operation is carried out by the switching mechanism. Alternatively, by utilizing the electromagnetic force, a locking device provided for the movable contactor or the stationary contactor is unlocked to quickly open the circuit. The interruption operation is accomplished with the subsequent ordinary circuit opening operation.

In a conventional multi-pole circuit breaker, a current limiting device of this type is provided for each of the poles. That is, the number of current limiting devices is equal to the number of poles. Accordingly, the conventional multi-pole circuit breaker is larger in size and higher in cost than a non-current-limiting type multi-pole circuit breaker having no current limiting device. As is well known in the art, when a three-phase short-circuit occurs, currents flow differently according to the phases, depending on the short-circuited phase, and progress through transient conditions. In the conventional circuit breaker, current limiting devices are provided for all of the poles, respectively, to operate independently. Accordingly, at the time of interruption, the current limiting device for a phase highest in current increase factor (di/dt) is first operated to open the circuit. Therefore, the current of a phase smaller in current increase factor, i.e. the minor loop current is not always interrupted (the first phase interruption). Depending on the short-circuit current magnitude and the short-circuit phase, the major loop current high in current increase factor may be subjected to first phase interruption. If the voltage is high, the interruption is severe.

SUMMARY OF THE INVENTION

An object of the invention resides in that a current limiting device is provided only for the pole provided with a switching mechanism.

That is, according to this invention only one current limiting device is provided, so that it is operated when the sum of electromagnetic forces applied to the contactors of all of the poles reaches a predetermined value or when large current flows in one of the poles to increase the electromagnetic force to a predetermined value. This operates to simultaneously operate the contactors of all of the poles to open the circuits. Hence, a multi-pole circuit breaker can be manufactured low in manufacturing cost and small in size.

This invention will be described in detail with respect to the accompanying drawings and the description of the preferred embodiment that follows.

DESCRIPTION OF THE PREFERRED EMBODIMENT

One preferred embodiment of this invention will now be described with reference to the accompanying drawings.

Figure 1:
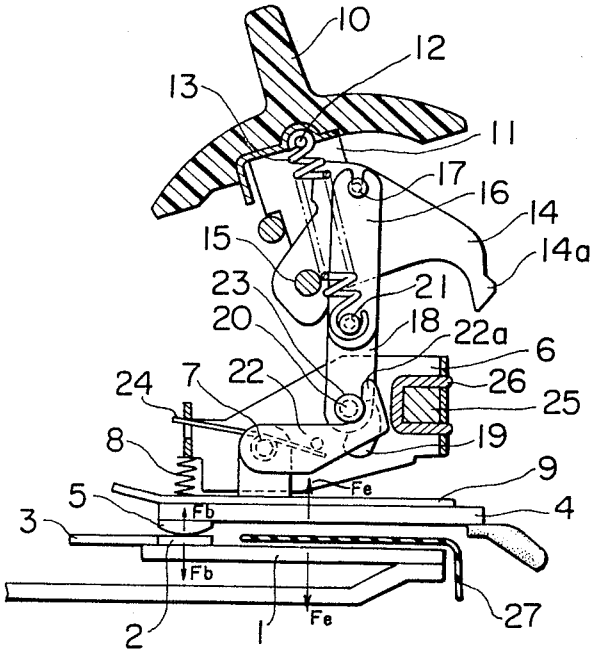
Figure 5:
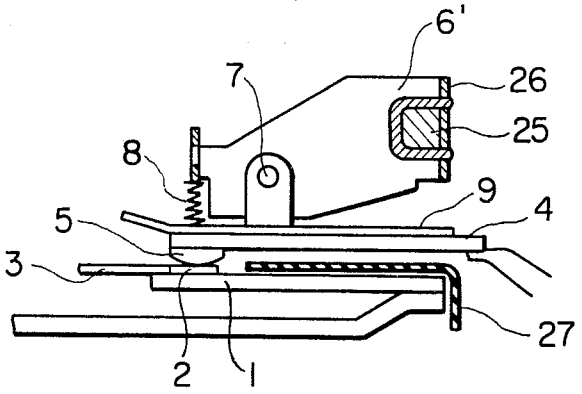
FIG. 5 is a side view of a typical one of the remaining poles of the circuit breaker according to the invention.

FIG. 1 shows the essential components of a central pole, with a switching mechanism, of a multi-pole circuit breaker, and FIG. 5 shows the essential components of the other poles, with the circuit breaker closed. In the figures, reference numeral 1 designates a U-shaped stationary contactor extending from a power source side terminal and having a stationary contact 2 and an arc horn 3. Element 4 is a movable contactor having a movable contact 5, the movable contactor 4 being fixedly secured, by securing means such as rivets, to a support 9 which is rotatably mounted on the rod 7 of a holder 6 and is energized counterclockwise at all times by a spring. A switching handle 10 is coupled to a lever 11 movable around a rod (not shown).

The lever 11 has a rod 12 which holds one end of a switching spring 13. A latch 14 is rotatable around a rod 15 having one end portion engaging the receiving part of an over-current tripping device (not shown). A first link 16 is rotatable around a rod 17 of the latch 14 and a second link 18 with a rod 20 which is engaged with a slot 19 of the holder 6. The first and second links 16 and 18 form a two-articulated link mechanism by using a common rod 21 which holds the other end of the switching spring 13.

Furthermore, in the figures, reference numeral 22 designates a latch which is rotatable around the rod 7 of the holder 6 and has an end portion **22*a* which engages with a roller 23 (whose outside diameter is larger than the width of the slot 19) coaxial with the rod 22. The latch 22 is normally energized counterclockwise by a spring 24 to prevent the rod 20 from slipping down the slope 19*a* (cf. FIG. 6) of the slot 19. An insulating rod 25 is common to all of the poles and is adapted to hold the holders 6 and 6' with the aid of metal fittings 26. The insulating rod 25 has rotation fulcrums 25*a* at the both ends. Finally, element 27 is an insulating barrier inserted between the stationary contactor 1 and the movable contactor 4**.

Figure 2:
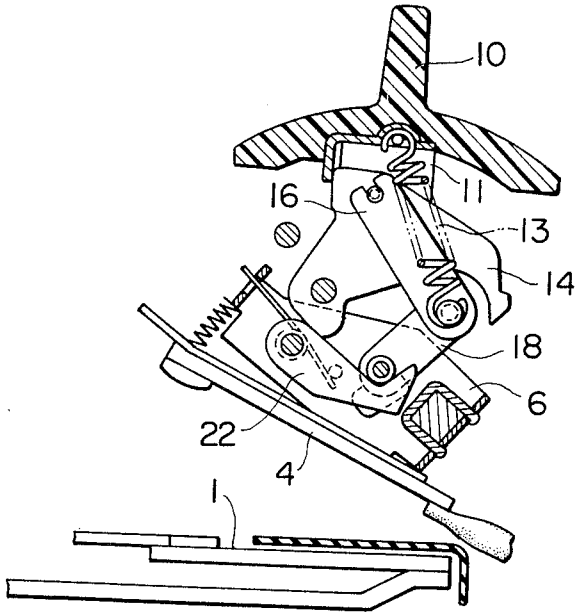
FIGS. 1 through 4 are side views showing different states of the central pole of a circuit breaker according to this invention.

In order to open the circuit breaker thus constructed by external operation, the handle 10 is operated clockwise as shown in FIG. 2. Simultaneously the lever 11 is turned clockwise, and therefore the switching spring 13 is turned around the rod 21. As soon as the axial line is moved over the rod 17, the first link 16 and the second link 18 are collapsed. As a result, the holder 6 is turned clockwise around the rod 25 to cause the movable contactor 4 to separate from the stationary contactor as shown in FIG. 2.

To close the circuit breaker, the handle 10 is operated counterclockwise. As a result, the switching spring 13 is moved over the dead point, the first and second links 16 and 18 are moved in the opposite direction, and the holder 6 is turned counterclockwise around the rod 25*a*. Thus, the contactors are placed in closed state as shown in FIG. 1.

When current is allowed to flow in the circuit breaker which operates as described above, then an electromagnetic force Fb represented by the following equation (1) is generated between the contacts 3 and 5 by current concentration. An electromagnetic force Fe represented by the following equation (2) is generated between the contactors 1 and 4 by currents which flows in the opposite directions:

$$Fb=5I^2\times10^{-2}(Kg) \quad (1)$$

$$Fe=2.04K(L/S)I^2\times10^{-2}(Kg) \quad (2)$$

where: I is the current (KA), K is the configuration factor, L is the conductor length (mm), and S is the gap (mm) between conductors.

These electromagnetic forces act in the opposite directions with respect to the direction of rotation of the contact 4 about the rod 7. When the current is increased, as is clear from the equations, each electromagnetic force is increased in proportion of the square of the current. In the preferred embodiment of the invention, the pivotally supporting positions, the length of conductors, and the gap between the conductors are selected so that, when the electromagnetic forces Fb and Fe act, the movable contact 4 is turned counterclockwise around the rod 7, i.e. the forces act to increase the contact pressure.

The electromagnetic forces Fb and Fe act through the rod 7 on the holder 6 so that it turns clockwise around the rod 25*a*. Therefore, a counterclockwise moment with the rod 21 as the center is applied to the second link 18 having the rod 20 engaged with the slot of the holder. On the other hand, a clockwise moment with the rod 7 as the center is applied to the latch 22 which engages with the rod 20 through the roller 23.

However, the latch 22 is maintained at rest by the spring 24 when the current is relatively small. That is, since the circuit breaker is designed so that the torsional moment of the spring is greater than the clockwise moment which is applied to the latch 22 by the electromagnetic forces Fb and Fe generated by the relatively small current, the closed circuit state is maintained as shown in FIG. 1. When a large current such as short-circuit current flows, then the moment applied to the latch 22 becomes greater than the elastic force of the spring to turn the latch 22 clockwise. As a result, the roller 23 is disengaged from the latch end portion 22*a*, and therefore the second link 18 is turned counterclockwise around the rod 21.

Figure 3:
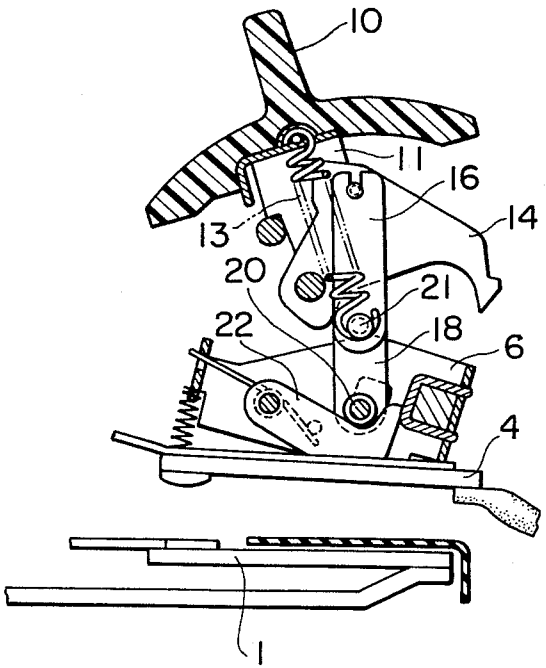

Accordingly, the rod 20 comes off the slope 19*a* of the slot 19 of the holder 6. The holder 6, while guiding the rod 20 to the vertical groove of the slot 19, is affected by the electromagnetic forces and turns clockwise around the rod 25, to move the movable contactor 4 to the position as shown in FIG. 3.

Figure 4:
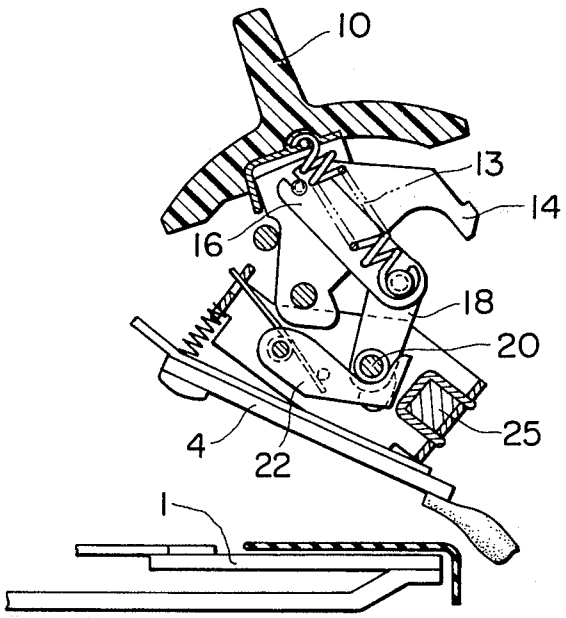
Figure 6:
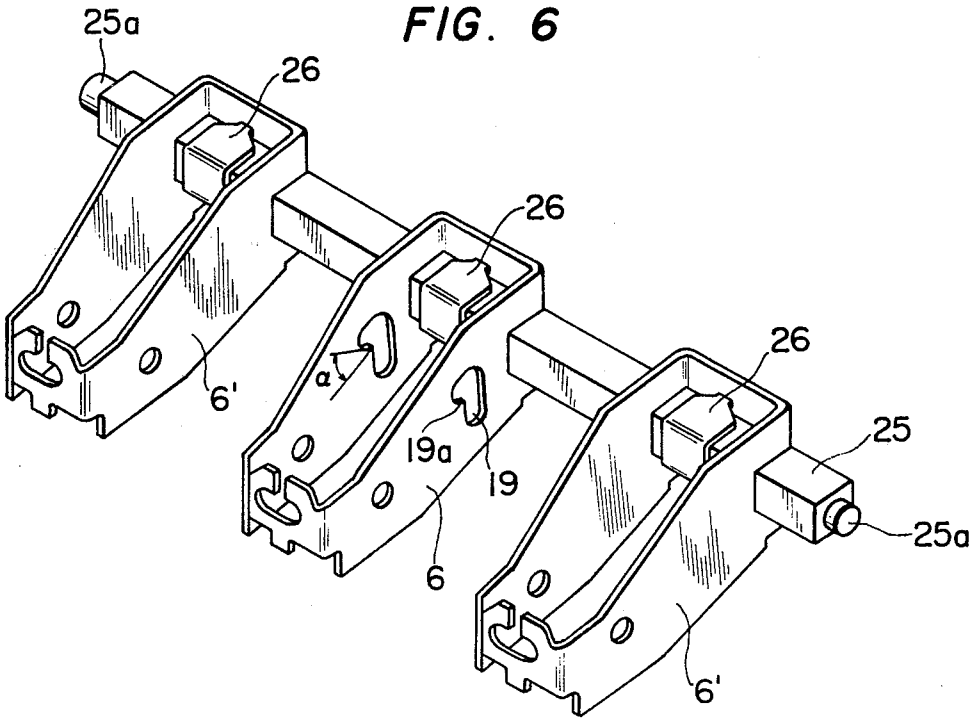
FIG. 6 is a perspective view showing essential parts of the circuit breaker according to the invention.

In this operation, as is apparent from FIGS. 5 and 6, the holders 6' of the other poles are turned simultaneously. That is, the movable contactors of the other poles are moved substantially at the same time to open the circuits. These movable contactors 4 are set as shown in FIG. 4 by the subsequent opening operation. In this case, the latch 22 is engaged with the roller 23 again as follows. That is, the latch 14 is unlocked by the operation of the tripping device (not shown), and is turned about the rod 15. The first link 16 is moved counterclockwise with the turning of the latch 22, whereupon the rod 20 is moved upwardly (toward the handle). Because the rod 20 is moved this way, the holder 6 is turned by the electromagnetic force until it is brought into contact with the rod 15, and then it is held there. However, since a restoring force is applied to the rod 20 by the spring 24, the rod 20 is further moved to run in the slot 19, and it is engaged with the slope 19*a* shown in FIG. 6.

The circuit breaker thus opened can be closed by turning the handle 10 clockwise to the reset position shown in FIG. 2.

The value of the current with which the current limiting device operating as described above releases the engagement of the latch end portion 22*a* to start the operation can be determined by suitably selecting the angle $\alpha$ of the slope 19*a* of the slot 19, and the spring 24.

Figure 7:
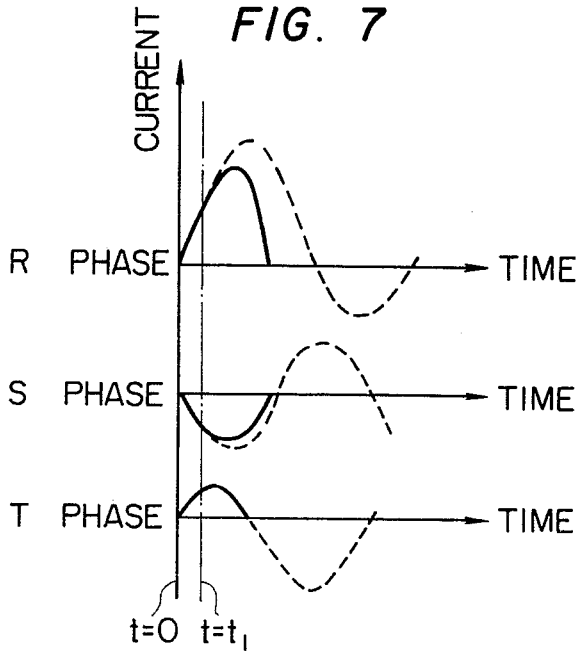
FIG. 7 is a graphical representation indicating interruption waveforms of the circuit breaker according to the invention.

When currents as indicated by the broken lines in FIG. 7 flow in the poles of the circuit breaker thus organized, then the above-described electromagnetic forces Fb and Fe are applied to the holders 6 and 6'. The electromagnetic force applied to the holder when a period of time $t=t_1$ has passed from the short-circuit occurrence time instant $t=0$ is maximum for the R phase high in current increase factor (di/dt).

The latch 22, in this case, is operated when a moment applied to the latch 22 on the basis of the electromagnetic force acting on the R phase exceeds the elastic force of the spring, or when, if the electromagnetic force is insufficient, the moment acting on the latch 22 on the basis of the sum of the electromagnetic forces acting on the R, S and T phases (the electromagnetic forces of the poles being transmitted to the holder 6 of the central pole) exceeds the elastic force of the spring 24. Thus, the movable contactors 4 are moved to open the circuits (accordingly, $t_1$ designating the contactor opening time instant).

Accordingly, the minor loop current can be interrupted, and as shown in FIG. 7, the T phase is for the first phase interruption. The R and S phases are for the series interruption; that is, if two poles share the line voltage, then the interruption can be readily achieved, and the passing current square product ($\int i^2/dt$), passing current peak value and arc energy can be greatly reduced.

As is apparent from the above description, according to the invention, the number of current limiting devices can be decreased, and the interruption performance is improved. Therefore, the circuit breaker provided by the invention is small in size, low in cost and high in performance.

What is claimed is:

1. In a circuit breaker having stationary contactors provided respectively for all of the poles thereof; movable contactors provided respectively for all of the poles in correspondence to said stationary contactors; stationary contacts provided respectively on the end portions of said stationary contactors; and movable contacts provided respectively on the end portions of said movable contactors, said movable contactors being movable from said stationary contactors by electromagnetic force to open respective circuits before said circuit breaker is opened by an overcurrent tripping device when a large current such as short-circuit current flows, the improvement comprising holders adapted to hold said movable contactors of all of the poles mounted on a common rotatable insulating rod (25), one of said holders (6) holding one of said poles having latch means (22) rotatable around a first rod 7 provided on said holder; a second rod (20) normally engaged by said latch means, and guide slots (19) in said one holder for guiding said second rod, wherein said second rod is movable in said guide slots when disengaged by said latch means, and an engaging spring (24) operating to engage said latch means with said second rod until a rotational moment acting on said latch due to a repulsive electromagnetic force generated in any one of the poles or the sum of repulsive electromagnetic forces generated in all of the poles reaches a predetermined value, whereupon said one holder rotates with said guide slots moving relative to said second rod, and said movable contactors of all of the poles are simultaneously separated from said stationary contactors to open the respective circuits with the aid of said insulating rod and said holders.

2. The circuit breaker of claim 1 further comprising a switching handle, an articulated link mechanism coupled by a common pin and a switching spring coupling said common pin to said switching handle.

3. The circuit breaker of claim 2 wherein said second rod is mounted on one member of said articulated link mechanism.

4. The circuit breaker of claim 1 further comprising a bias spring disposed to bias said latch means in a direction opposite to said engaging spring.

5. The circuit breaker of claim 2 further comprising a second latch having an engaging pin, said link mechanism having one member rotatable about said engaging pin, said second latch having a receiving portion for an overcurrent tripping device.

6. The circuit breaker of claims 1, 2, 3, 4 or 5 further comprising an insulating barrier inserted between said stationary contactors and said movable contactors.

* * * * *